US005090598A

United States Patent [19]

Stull

[11] Patent Number: 5,090,598

[45] Date of Patent: Feb. 25, 1992

[54] DISPENSER CONSTRUCTION

[76] Inventor: Gene Stull, 1 Winston Farm La., Far Hills, N.J. 07931

[21] Appl. No.: 527,363

[22] Filed: May 23, 1990

[51] Int. Cl.[5] ..... B65D 47/06

[52] U.S. Cl. ..... 222/153; 222/520; 222/549

[58] Field of Search ..... 222/153, 519, 520, 522, 222/525, 531, 532, 537, 548, 549

[56] References Cited

U.S. PATENT DOCUMENTS

| | | | |
|---|---|---|---|
| 3,357,605 | 12/1967 | Chadfield | 222/548 X |
| 3,439,843 | 4/1969 | Corsette | 222/520 X |
| 3,751,787 | 8/1973 | Porter | 222/532 X |
| 4,261,487 | 4/1981 | Seager | 222/520 |
| 4,424,918 | 1/1984 | Stull | 222/153 |
| 4,497,422 | 2/1985 | Klees | 222/548 X |
| 4,605,225 | 8/1986 | Zimmermann | 222/566 |

FOREIGN PATENT DOCUMENTS

| | | | |
|---|---|---|---|
| 0980392 | 1/1965 | United Kingdom | 222/548 |
| 1526229 | 9/1978 | United Kingdom | 222/519 |

*Primary Examiner*—Michael S. Huppert
*Assistant Examiner*—Edward M. Wacyra
*Attorney, Agent, or Firm*—H. Gibner Lehmann; K. Gibner Lehmann

[57] ABSTRACT

A dispenser construction having a tubular fitment member with an open end, and a stopper member having an annular wall and a side opening therein. The stopper member has a discharge passage communicating with the side opening and a discharge orifice at the end of the discharge passage. The stopper member is carried in the open end of the fitment member, and is axially movable thereon between a raised, discharge position, and a lowered, sealing position. Sealing structures are provided on the open end of the fitment member and on the annular wall of the stopper member, and disposed above the location of the side opening thereof, to prevent leakage of liquid. Valve structures are also provided on the fitment member and stopper member, establishing communication between the open end of the fitment member and the side opening and discharge passage of the stopper member when the latter is disposed in its raised, discharge position, and for blocking communication between the open end of the fitment member and the side opening and discharge passage of the stopper member when the latter is disposed in its lowered, sealing position.

15 Claims, 2 Drawing Sheets

DISPENSER CONSTRUCTION

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are under any Federal program.

BACKGROUND OF THE INVENTION

1. Field of the Invention

This invention relates generally to hand-held dispensers, and more particularly to dispensers of simplified or basic construction, which are economical to mold and assemble.

2. Description of the Related Art Including Information disclosed under 37 CFR §§1.97-1.99

Prior dispenser cap constructions have typically employed a member provided with screw threads that mated with cooperthreads on the neck of a container or bottle, and a twist cap carried on the base member and movable between advanced and retracted positions thereon. The twist cap contained a discharge pening, and the latter was capable of being sealed off by an closure peg on the base member. Various combinations tracks/thread structures have been employed in order to effect the desired axial movements of the twist cap in response to turning forces applied thereto.

My U.S. Pat. No. 4,424,918 dated Jan. 10, 1984 and entitled NON-RESEALABLE DISPENSER CAP CONSTRUCTION, illustrates prior construction having the features set forth above. Numerous other patents exist, which disclose various types of twist or pull-to-open caps.

However, it is believed that there exists a specific need for a functional dispenser which is especially simple, and which can be manufactured at lower cost than existing designs currently in use.

SUMMARY OF THE INVENTION

Accordingly it is an object of the present invention to provide a novel and improved dispenser construction which is extremely simple in its structure, and capable of being manufactured at reduced cost, without sacrifice of ease of use or reliable sealing characteristics.

Yet another object of the invention is to provide an improved dispenser construction as above set forth, wherein the parts can be easily molded in relatively simple cavities, and thereafter assembled with minimal time and effort.

A still further object of the invention is to provide an improved dispenser as above characterized, which is believed to be both rugged and reliable in use, and which is resistant to inadvertent leakage and other types of malfunction, in spite of its simplicity.

In accomplishing the above objects the invention provides a tubular fitment member having an open end, a stopper member having an annular surface and a side opening therein, and further having a discharge passage communicating with the side opening and a discharge orifice at the end of the discharge passage. There are provided means movably mounting the stopper member in the open end of the fitment member, the stopper member being axially movable on the fitment member between a raised, discharge position, and a lowered, sealing position. Cooperable sealing means are provided on the open end of the fitment member and on the annular surface of the stopper member, and disposed above the location of the side opening thereof, for preventing leakage of liquid past the open end when the stopper member is disposed in both its raised, discharge position and its lowered, sealing position. Cooperable valving means on the fitment member and the stopper member are arranged to establish communication between the open end of the fitment member and the side opening and discharge passage of the stopper member when the latter is disposed in its raised, discharge position, and for blocking communication between the open end of the fitment member and the side opening and discharge passage of the stopper member when the latter is disposed in its lowered, sealing position.

Other features and advantages will hereinafter appear.

DESCRIPTION OF THE PREFERRED EMBODIMENTS

Figure 2:
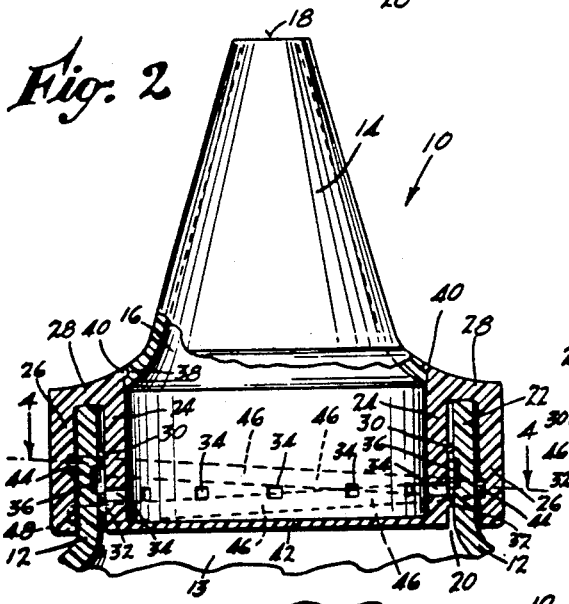
FIG. 2 is a fragmentary section taken on the line 2—2 of FIG. 1, and illustrating a fitment member and a stopper member carried thereby, with the stopper member being disposed in the lowered sealing position.
Figure 3:
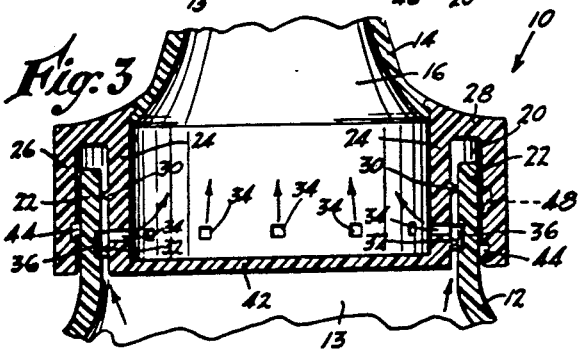
FIG. 3 is a fragmentary section like FIG. 2, except illustrating the stopper member occupying a raised, discharge position on the fitment member.

Referring first to FIGS. 2 and 3, there is illustrated a dispenser construction generally designated by the numeral 10, comprising a fitment member 12 which can be either the neck of a container or bottle, or else a base cap having suitable fastening means, such as a snap bead or screw threads, to permit it to be permanently secured on the neck of a container or bottle. The fitment member 12 has a bore 13. Also illustrated is a stopper member 14. The stopper member 14 is carried on the fitment member 12 and is axially movable thereon between a raised, discharging position shown in FIG. 3, and a lowered, sealing position shown in FIG. 2. The stopper member 14 preferably has a hollow interior or passage 16 which communicates with a discharge orifice 18.

In accordance with the present invention the stopper member 14 has a downwardly facing annular cavity or well 20 which receives the upper or lip portion 22 of the fitment member 12. As stopper member 14 is moved toward its lowered, sealing position, the lip portion 22 extends further into the well 20, as in FIG. 2. The well 20 has an inner annular wall 24, an outer annular wall 26, and a top wall 28. An upper sealing bead 30 is provided on the surface of the inner wall 24 of the well 20, for continuous engagement with the inner surface of the lip portion 22 of the fitment member 12. This bead 30 is annular, and maintains a seal with the fitment member 12 for both the raised, discharge position of the stopper member 14, and the lowered, sealing position thereof.

Further by the invention there is provided a valve structure on the stopper member 14 and fitment member 12, comprising second annular bead 32 on the surface of the inner wall 24 of the well 20, which is adapted to engage and seal with the inner surface of the lip portion 22 of the fitment member 12 as in FIG. 2, when the stopper member 14 is disposed in its lowered, sealing position. The inner wall 24 of the well 20 has a plurality of side openings 34 positioned about its circumference, these side openings 34 being disposed at a location which is axially between the beads 30 and 32. In addition, the inner surface of the lip portion 22 of the fitment member 12 has a relieved area, which is illustrated as being an annular trough 36, but which may take the form of one or more individual pockets or indentations in the wall of the lip portion 22, if desired.

In order to produce the configuration shown, it is necessary to mold the stopper member 14 as two individual pieces, one being in the form of a hollow truncated cone or nozzle and containing the discharge orifice 18, and the other being in the form of a double walled annulus, the walls 24, 26 of which define the well 20. The junction of the two parts preferably has a retainer means in the form of a cooperable groove on one piece, and retainer bead on the other. The groove is indicated 38, whereas the bead is designated 40. Other forms of retention can be employed in order to provide the desired permanent connection of the two parts constituting the stopper member 14.

In the present construction, the bottom of the stopper member 14 has a substantially flat, expansive wall 42 which serves to block off the interior of the stopper member 14, and effectively isolate it from the interior of the fitment member 12. As a consequence, there is no communication between the interior of the fitment member 12 and the interior of the stopper member 14 when the latter is disposed in the closed, sealing position of FIG. 2.

In addition, by the invention, cooperable means are provided on the fitment member 12 and stopper member 14, for effecting axial shifting of the latter in response to relative turning force applied thereto. In particular, the outer surface of the lip portion 22 of the fitment member 12 is illustrated as having two oppositely disposed radially-extending camming projections or nibs 44 which are received in cooperable cam tracks or grooves 46 provided on the inner surface of the outer wall 26 of the

Figure 1:
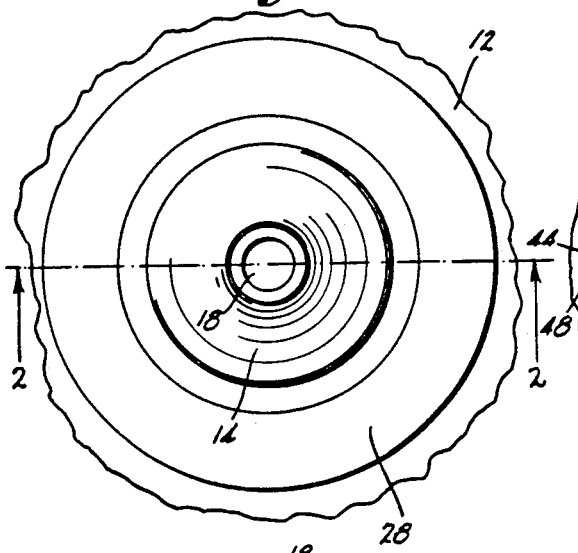
FIG. 1 is a top plan view of the improved dispenser construction of the invention.
Figure 4:
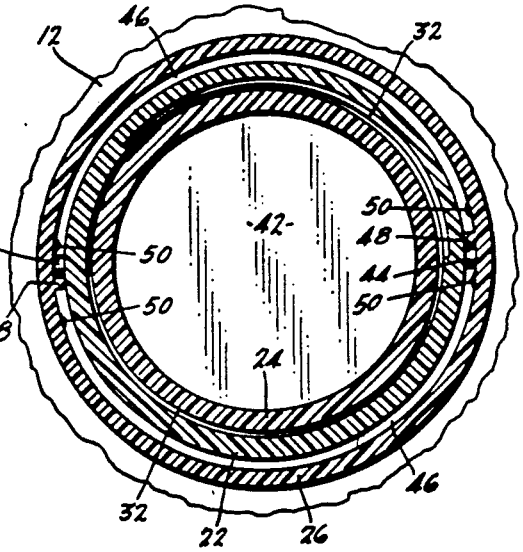
FIG. 4 is a section taken on the line 4—4 of FIG. 2.

20. The cam grooves 46 are illustrated in FIGS. 2 and 4, being semi-circular with their ends being indicated 48 in

4. During initial assembly of the stopper member 14 to the fitment member 12, the outer wall 26 of the well 20 is forced the projections or nibs 44 until they arrive at and become in the respective cam groove 46.

While the disclosed embodiment illustrates two projections 44 and two cam grooves 46, requiring the stopper member 14 to be through an angle of just under 180° between open and positions, it can be understood that a single projection could be provided, or more than two projections and depending upon the desired degree of control of movement of the stopper member 14 with respect to the fitment member 12. For example, four projections and four cam tracks could be where it is desired that the stopper member 14 shift its raised, discharge position and its lowered, sealing position by means of a quarter turn of the stopper member 14.

Further by the invention, either or both of the cam tracks or grooves 46 is preferably provided with detent ribs 50 adjacent opposite ends of the tracks, such detent ribs 50 extending slightly into the path of the respective projections 46 when the stop member 14 is turned, so as to retain the same in either a fully open or a fully closed position. While the detent ribs 50 are illustrated as occupying the outermost wall of the cam grooves 46, they could be disposed on either side wall of such grooves and still provide the desired degree of interference against inadvertent turning of the stopper member 14.

In use, FIG. 2 illustrates the dispenser in the sealed condition, such as for storage or shipping. The projections 44 each occupy the upper ends of the respective cam grooves 46, and the beads 30 and 32 engage the inner surface of the lip portion 22 on opposite sides of the annular groove or depression 36. Under this circumstance the contents of the interior of the fitment member 12 are isolated from the side openings 34 and interior of the stopper member 14 not only by the wall 42, but also by the bead 32. If the stopper member 14 is now turned in a counterclockwise direction, the cam grooves 46 in the outer wall 26 of the well 20 will cause the stopper member 14 to ride up the projections 44 and after an excursion of just under 180°, the stopper member 14 will arrive at the raised, discharge position of FIG. 3. While the bottom wall 42 of the stopper member still isolates the interior thereof directly, the bead 32 has been shifted sufficiently to uncover the groove or depression 36, permitting access to the side openings 34 of the stopper member 14 from the interior of the fitment member 12, and product flow can occur as indicated by the arrows in FIG. 3. In particular, when the fitment member 12 and stopper member 14 are inverted, product can flow past the bead 32 and depression 36, into the side openings 34 and interior 16 of the stopper member 14, and out through the discharge orifice 18 thereof.

The present dispenser is adapted for use with products that are intended to be mostly or completely exhausted following initial opening of the dispenser, since the product immediately occupies and flows through the interior 16 of the stopper member 14 and there exists no sealing mechanism, such as a sealing plug, for the discharge orifice 18, as in a number of other, known dispensers. The elimination of such a sealing plug is desirable from the standpoint of enabling the present dispenser to have the simplest possible structure, whereby it can be fabricated at an especially low cost.

Figure 5:
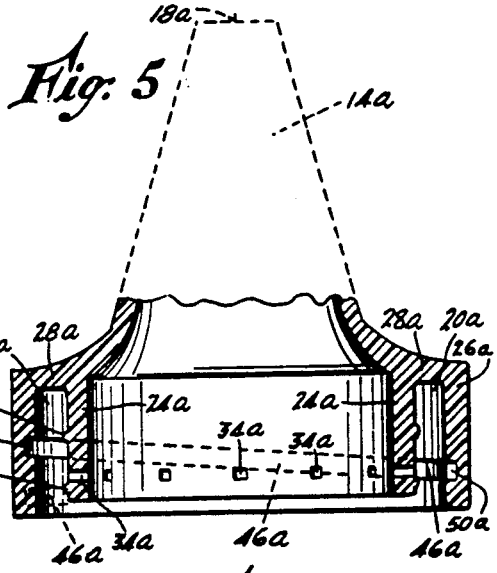
FIG. 5 is a vertical section of a modified stopper member, for use with the fitment member of FIGS. 1–4, constituting another embodiment of the invention.
Figure 6:
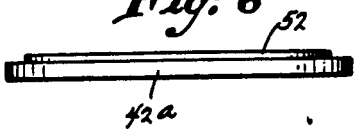
FIG. 6 is a side elevation of a bottom plate employed with the stopper member of FIG. 5.

Another embodiment of the invention is shown in FIGS. 5 and 6, wherein like reference numerals with the suffix "a" have been assigned to corresponding parts. There is illustrated a stopper **14*a* having a truncated cone or nozzle containing a discharge orifice 18*a*, and an annular well 20*a* having an inner wall 24*a*, an outer wall 26*a*, and a top wall 28*a*. The inner wall 24*a* has side openings 34*a*, as in the previous embodiment, and sealing and valving beads 30*a*, 32*a* respectively. One cam groove 46*a* on the inner surface of the outer wall 26*a* of the well 20*a*** is also shown.

In accordance with the invention, the stopper member 14a is constituted of two separate molded pieces or parts, one being the integrally molded nozzle and well formation, and the other being a bottom plate 42a constituting the bottom wall of the stopper member 14a, and being sealed in place. The sealing can be accomplished by suitable glue or by means of sonic welding. The bottom plate 42a preferably includes a raised plateau 52 so to facilitate centralization of the plate with respect to the wall 24a. The objective of providing a separate bottom plate 42a to enable the nozzle and well formation to be molded as a single piece. As can be appreciated, it is not possible to mold the stopper member 14 or 14a as a single piece in the form indicated, and accordingly the need for separate molds arises.

Figure 7:
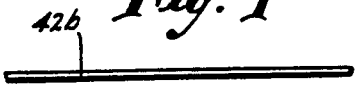
FIG. 7 is an edge view of a foil disk which can constitute an alternative closure wall for the stopper member of FIG. 5.

In place of the molded bottom plate 42a, a foil disk 42b as in FIG. 7 can be sealingly applied and cemented, or otherwise fastened to the bottom edge of the wall 24a. Such a foil disk can be relatively thin, similar to those currently used to provide a safety or tamper-evident seal of the lip of a conventional dispenser of the screw-cap type. Since the stopper member is normally captive on the container or fitment member, the disk would not be accessible from the exterior of the dispenser. Moreover, during the course of use of the dispenser it would not even be visible to the consumer, and thereby the possibility of its being inadvertently punctured or otherwise damaged is virtually eliminated.

Figure 8:
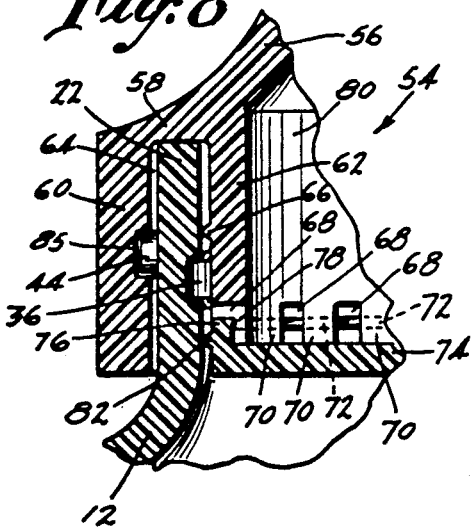
FIG. 8 is fragmentary axial sectional view of a dispenser construction constituting another embodiment of the invention.

Yet another embodiment of the invention is illustrated in FIG. 8, showing a somewhat simpler arrangement for effecting the molding and fabrication of the dispenser parts. In this figure, the dispenser construction 54 comprises a stopper member 56 having a top wall portion or shoulder 58 from which depend an outer annular wall 60 and an inner annular wall or skirt 62 defining an annular well 64. Received in the well 64 is the lip portion 22 of the fitment member or neck 12 of the container, having on its exterior the projections or nibs 44 and in its bore the annular trough or groove 36.

The inner annular wall 62 has an exterior upper sealing bead 66 which engages the inside wall of the lip portion 22 and which is adapted to ride up thereon to a raised position, and which maintains its sealing engagement with the lip portion for both the raised, discharge position and the lowered, sealing position of the stopper member 56.

By the invention, the lower edge of the inner annular wall 62 has a series of notches or side openings 68 forming toothlike portions 70, and said portions have outer retention grooves 72 shown by the dotted lines. Also, carried by the inner annular wall 62 is a bottom plate 74 having an annular upstanding flange 76 at the inner top edge of which there is provided an annular retention bead 78 that is received in the grooves 72. Thus, by a snap fit, the bottom plate 74 is both mechanically and sealingly attached to the bottom of the inner annular wall 62, while at the same time the side passages 68 are clear to provide for the flow of liquid into the bore 80, as will be explained below.

Further, by the invention the flange 76 has a valving bead 82 slidably and sealingly engaging the inner surface of the lip portion 22, such bead being shifted to a position in line with the trough 36 when the stopper member 56 is raised for discharge. The outer wall 60 has a cam groove or track 85 to accommodate the nibs 44, as will be understood. This raising action is similar to that described above, for the previous embodiments. With the embodiment of FIG. 8 the stopper member 56 can be quite readily molded, and pulled from mold cavities. In addition to the snap retention, suitable adhesive may be employed with the plate 74, if desired. Alternately, the plate 74 can be merely a flat member glued or heat sealed or fused to the bottom edge of the wall 62.

Figure 9:
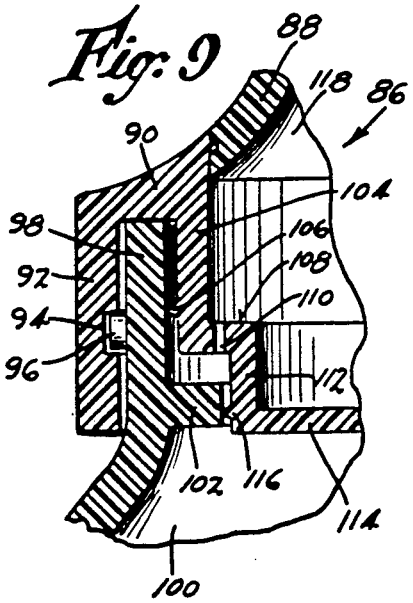
FIG. 9 is a fragmentary axial sectional view of a dispenser construction constituting yet another embodiment of the invention

Still another embodiment of the invention is illustrated in FIG. 9, showing a dispenser construction 86 comprising a spout portion 88 that is interlockingly attached to the top wall or shoulder 90 of the stopper member in the manner already explained above in connection with FIGS. 2 and 3. The wall 90 has an outer depending annular wall 92 with cam groove or track 94, the latter accommodating nibs 96 on the lip portion 98 of the container or fitment member 100. In this embodiment, the container or fitment member 100 has an annular inner flange 102 to constitute a valving part now to be explained.

An inner annular wall 104 depends from the shoulder 90, and has an exterior sealing bead 106 riding on the bore of the lip portion 98. At its lower end, the inner wall 104 has a transverse shoulder 108 in which there is a series of liquid passages 110. Depending from the shoulder 108 is an inwardly offset wall 112 connected at its bottom to a bottom wall 114. The walls 112 and 114 near their juncture have an annular valving bead 116 which can ride on the inner edge of the flange 102 and upwardly, ride off the same and into the space above the flange. A valving action is thus had, to control the discharge of liquid from the container 100. When the valve is open, liquid can flow past the valving bead 116 and through the passages 110 into the bore 118 of the discharge spout portion 88.

In the case where the stopper member is molded either in the form of FIGS. 2 and 3, or in the form of FIG. 9, it is possible as an option to use different colored plastics for the two parts, imparting an unusual, desirable appearance to the dispenser construction. This can have a distinct advantage from the marketing standpoint, where an eye-catching characteristic is desired. It is noted that no additional cost would be involved in such a dualcolor construction, since the same molds would be used regardless of the ultimate choice of color combination.

From the above it can be seen that I have provided a novel and improved dispenser which is extremely simple in its structure, making it especially economical to mold and assemble. The functionality of the device with respect to ease of use and integrity of the seal is maintained, at a significantly reduced cost. The cap construction of the present invention is thus seen to represent a distinct advance and improvement in the field of hand-held dispensers.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A dispenser construction comprising, in combination:

a) an open-ended tubular fitment member provided with a discharge bore, said member being adapted to have a flowable substance pass through said bore, and b) a stopper member axially movable on and cooperable with said fitment member to permit or else halt the flow of substance through said fitment member depending on the axial positioning of the stopper member thereon, said stopper member having inner and outer annular walls forming an annular cavity in which the end of the fitment member fits and in which said end is turnable and axially movable, c) said fitment member having in its bore an annular internal groove and said stopper member having on its inner annular wall a pair of spaced-part annular beads which engage the walls of the bore of the fitment member and span the internal groove of the fitment member for one relative axial position of the stopper member and fitment member, d) said stopper member being axially movable on the fitment member from said one relative axial position to a second relative axial position to cause one of said beads to bypass the said annular groove, e) the inner annular wall of said stopper member forming a large interior discharge bore, and said stopper member having a connecting passage in said inner annular wall, communicating with said interior discharge bore and with the space between said beads whereby flowable substance can be discharged from the fitment member through said stopper member for the said second relative axial position of the stopper member and fitment member, f) said stopper member having a transverse closure bottom wall enclosing said large interior discharge bore and forming with said inner annular wall of the stopper member a cup-like structure which isolates the discharge bore from the interior of said fitment member.

2. A dispenser construction as set forth in claim 1, wherein the transverse closure bottom wall is integrally formed with said inner annular wall.

3. A dispenser construction as set forth in claim 1, wherein:

a) said stopper member has a nozzle part, molded as a separate piece from the inner annular wall, and b) means joining said nozzle part to said inner annular wall.

4. A dispenser construction as set forth in claim 3, wherein:

a) said nozzle part is constituted as a truncated cone.

5. A dispenser construction as set forth in claim 3, wherein:

a) said joining means comprises cooperable retention shoulders on said nozzle part and said inner annular wall.

6. A dispenser construction as set forth in claim 3, wherein:

a) said nozzle part and outer annular wall are characterized by different, contrasting colors.

7. A dispenser construction as set forth in claim 1, wherein:

a) said stopper member has a nozzle part molded integrally with said inner annular wall, said closure bottom wall being molded as a piece separate from said inner annular wall, and b) means joining said closure bottom wall to said inner annular wall.

8. A dispenser construction as set forth in claim 1, and further including:

a) a camming projection on one of said members, and b) a cam track on the other of said members, and engageable with said camming projection to effect said axial movement of the stopper member with respect to the fitment member.

9. A dispenser construction as set forth in claim 8, wherein:

a) said cam track has a detent nib adjacent one end, for engagement by the camming projection to retain and stopper member in its raised, discharge position against in advertent turning, and b) a second detent nib adjacent the other end of the cam track, for engagement by the camming projection, to retain the stopper member in its lowered, sealing position against inadvertent turning.

10. A dispenser construction as set forth in claim 1, and further including:

a) means movably mounting the stopper member in the discharge bore of the fitment member, said fitment member having a lip portion, b) said mounting means comprising a camming projection on the lip portion of the fitment member, and c) a cam track in the outer annular wall of the stopper member, receiving said camming projection.

11. A dispenser construction as set forth in claim 1, wherein:

a) said stopper member is constituted of at least two parts, one part having a tubular spout portion comprising said annular walls, said spout portion and annular walls being molded integrally with one another, b) the inner annular wall having a notch in its lower edge, c) said other part comprising said transverse closure bottom wall, said transverse closure bottom wall being connected to and retained on the lower edge of the inner annular wall, d) the walls of said notch and one portion of the transverse closure bottom wall defining said connecting passage, said connecting passage providing communication between the opposite sides of the inner annular wall.

12. A dispenser construction as set forth in claim 1, wherein:

a) said inner annular wall and transverse closure bottom wall have cooperable interfitting retaining means for securing the transverse closure bottom wall in position on the inner annular wall.

13. A dispenser construction as set forth in claim 1, wherein:

a) said transverse closure bottom wall comprises a foil type material.

14. A dispenser construction for liquids comprising, in combination:

a) a tubular fitment member having an open end, b) a stopper member having an annular wall portion and an opening therein, said stopper member further having a discharge orifice communicating with said opening, c) means movably mounting said stopper member in the open end of said fitment member, said stopper member being axially movable on the fitment member between a raised, discharge position, and a lowered, sealing position, d) cooperable sealing means on said open end of the fitment member and of the annular wall portion of the stopper member, and disposed above the location of the opening thereof, preventing leakage of liquid past said open end when the stopper member is disposed in both its raised, discharge position and its lowered, sealing position, and e) cooperable valving means on said fitment member and said stopper member, establishing communication between the open end of the fitment member and the opening and the discharge orifice when the stopper member is disposed in its raised, discharge position, and for blocking communication between the open end of the fitment member and the opening and the discharge orifice when the stopper member is disposed in its lowered, sealing position, f) said stopper member being hollow, and being constituted of at least two parts, one part comprising a tubular spout portion containing said discharge orifice, the other part comprising said annular wall portion, said annular wall portion being adapted to be received in the open end of the fitment member, g) said annular wall portion having an upper vertical portion, a lower vertical portion, and a transverse wall connecting said upper vertical portion and said lower vertical portion, said transverse wall containing said opening, said opening providing communication between the interior of the hollow stopper member and the exterior thereof.

15. A dispenser construction as set forth in claim 14, wherein:

a) said fitment member comprises an annular flange on its inner surface, said fitment member annular flange being disposed axially below the location of the transverse wall of the stopper member, and radially outward of the lower vertical portion of the stopper member, b) said annular flange of the fitment member constituting part of the said valving means.

* * * * *